US005253800A

United States Patent [19]

France

[11] Patent Number: 5,253,800

[45] Date of Patent: Oct. 19, 1993

[54] PIZZA TRAY

[75] Inventor: Stephen L. France, Township of Convis, County of Calhoun, Mich.

[73] Assignee: Arvco Container Corporation, Kalamazoo, Mich.

[21] Appl. No.: 17,250

[22] Filed: Feb. 12, 1993

[51] Int. Cl.[5] ..... B65B 5/20

[52] U.S. Cl. ..... 229/109; 229/906; 206/557

[58] Field of Search ..... 206/557, 560; 229/902, 229/903, 906, 109, 163, 195

[56] References Cited

U.S. PATENT DOCUMENTS

| | | | |
|---|---|---|---|
| 2,147,563 | 2/1939 | Turner | 229/195 X |
| 2,522,597 | 9/1950 | Blandford | 229/195 X |
| 3,841,476 | 10/1974 | Elford | 229/109 X |
| 4,015,767 | 4/1977 | Ferriter | 229/195 X |
| 4,054,241 | 10/1977 | Meyers et al. | 229/109 |
| 4,279,374 | 7/1981 | Webinger | 229/903 X |
| 4,979,667 | 12/1990 | Seaman | 229/906 X |
| 4,993,625 | 2/1991 | Stease et al. | 229/109 |

*Primary Examiner*—Steven N. Meyers
*Assistant Examiner*—Jacob K. Ackun, Jr.
*Attorney, Agent, or Firm*—Flynn, Thiel, Boutell & Tanis

[57] ABSTRACT

A one piece pizza tray blank having a generally planar member and a pair of sidewalls capable of being folded upward therefrom. Each of the sidewalls has a pair of opposing extensions capable of being folded inward therefrom along vertical extension fold lines. Each of the extensions has a foot extending downward therefrom in the direction of the planar member. The feet are designed to lockingly engage with slots and pressure tabs in the corner regions of the planar member for lockingly engaging the sidewalls and extensions in a vertical position. The feet also act as supports to prevent the planar member holding a pizza from contacting a counter or table top upon which it may be placed. This pizza tray may be slid inside of an appropriate bag for pizza transport.

11 Claims, 4 Drawing Sheets

PIZZA TRAY

FIELD OF THE INVENTION

This invention relates to an improved tray intended for supporting a hot pizza thereon, which tray bearing the pizza thereon is then intended for packaging within a paper bag.

BACKGROUND AND SUMMARY OF THE INVENTION

Prepared ready-to-eat pizza for take-out or delivery is often packaged in a corrugated square box having an attached openable lid or cover. While such corrugated box has desirable properties for packaging and transporting a hot pizza, nevertheless, such box is costly.

Due to competitiveness in the pizza market, attempts have been made by some pizza retailers to minimize cost by adopting a packaging technique which does not utilize a corrugated pizza box. Such alternate packaging technique generally involves use of a separate flat support tray (typically of corrugated cardboard) for the pizza, with the tray (bearing a pizza thereon) then typically being packaged within a paper bag. Due to the minimal use of corrugated cardboard in the tray and the simplicity of the tray construction, coupled with the use of an inexpensive paper bag, the overall two piece package (tray and bag) can be less expensive than a corrugated pizza box.

When using this tray-bag packaging technique, in most instances the tray is merely a flat planar member formed typically as a circle so as to support the pizza thereon, whereby the tray can be inexpensively formed. As a variation thereof, there is also in use a tray formed of corrugated cardboard and having a generally rectangular base wall which supports the pizza thereon, with one opposing pair of side edges of the base wall having small-height sidewalls which fold upwardly slightly above pizza height in an attempt to provide some constraint and protection for the pizza. These upwardly folded sidewalls, however, do not lock in position, and hence can be undesirably folded downwardly and inwardly so as to contact the pizza.

While the tray-bag packaging technique may be less expensive than corrugated pizza boxes, nevertheless the tray-bag package does have significant and recognized disadvantages. The bag can be easily deflected downwardly or deformed so that it comes into contact with the pizza, hence causing the bag to stick to the pizza and also causing the bag to become wet from moisture or grease. While often times a small plastic spacer is positioned centrally on top of the pizza in an attempt to maintain the pizza spaced from the bag, nevertheless this not only requires a separate packaging element and labor, but this is also of minimal effectiveness with respect to preventing contact between the pizza and the wall of the paper bag. Further, when the tray is provided with a pair of upwardly folded side walls, these sidewalls are also of minimal effectiveness in preventing contact between the paper bag and pizza, and in fact the sidewalls themselves can fold downwardly to contact the pizza as discussed above. The tray-bag package also makes it difficult to handle and transport more than one packaged pizza at a time since the tray-bag package does not satisfactorily stack on top of one another, and in fact such stacking greatly increases the probability of the bag coming into contact with the pizza. Also, the tray-bag package is much less effective in retaining the heat of the pizza, and hence any extended transporting time will result in greater cooling of the pizza prior to reaching its destination.

All of the pizza packaging techniques discussed above, including both the known pizza trays and the known corrugated pizza boxes, have the added disadvantage that placing the box or tray directly on a table or other support top for any extended period of time may cause possible damage due to the moisture or grease in the pizza penetrating the corrugated cardboard and hence contacting the underlying table or support top.

Hence, there exists a need for an inexpensive pizza package which minimizes and in fact overcomes many of the disadvantages discussed above as associated with conventional corrugated pizza boxes or conventional tray-paper bag packaging combinations.

The present invention relates to an improved pizza package, specifically a pizza package which involves a tray for supporting a pizza with the tray being positionable within a paper bag, and in particular this invention relates to improvements associated with the pizza support tray so as to overcome many of the disadvantages noted above while at the same time providing a relatively inexpensive package which is convenient to both utilize and handle.

More specifically, the present invention relates to a pizza tray and a flat blank that is easily folded into a pizza tray having a pair of opposing sidewalls that lock in a vertical position, with the blank being cut so as to minimize the amount of corrugated cardboard. The sidewalls have extensions that fold inward from the sidewalls and which have feet extending downward that lockingly engage with the horizontal planar member of the blank by extending through slots therein, which slots are formed by score lines and respective foldable pressure tabs. The pressure tab folds downward about its respective fold line when a foot is pressed against it. The pressure tab lockingly engages the foot by pressing against it. A score line extension extending from each slot can be cut to accommodate a toe on each foot for providing additional locking of the foot. The feet project downwardly below the bottom of the tray and act as supports which prevent the bottom of the tray from coming into contact with a counter or table top.

Other objects, purposes and advantages of the invention will be understood from the following detailed description and drawings.

DETAILED DESCRIPTION

The present invention is directed to a flat cardboard blank 11 (FIG. 1) that can be folded into the shape of a tray 12 (FIGS. 2 and 3) suitable for support of a pizza.

Figure 1:
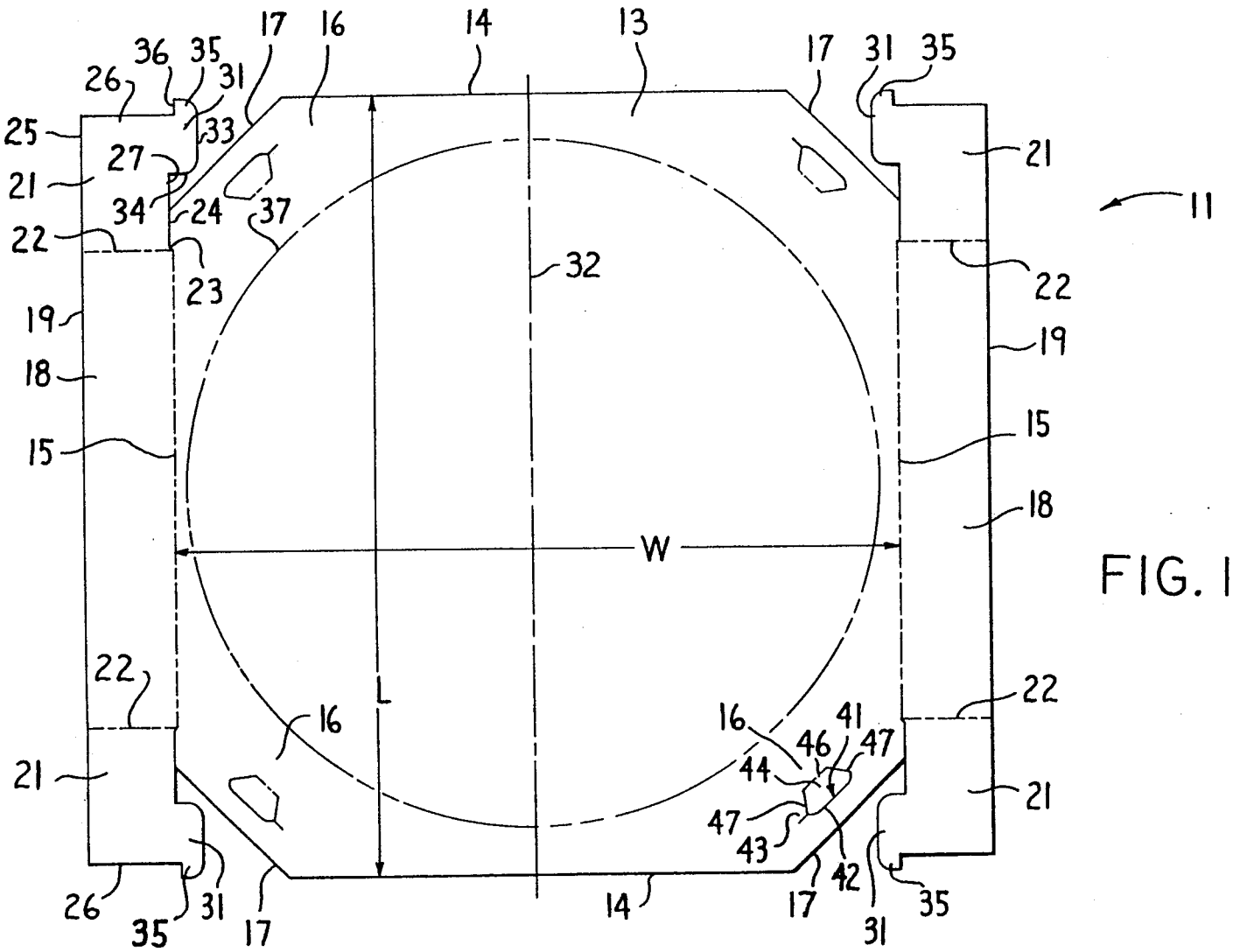
FIG. 1 shows a plan view of an unfolded flat blank of the present invention.

Referring initially to FIG. 1, the blank 11 is a flat and generally planar, one-piece element formed from a thin sheetlike material. The blank 11 is preferably cut from corrugated cardboard, the latter preferably being double faced corrugated in that the corrugated is defined by a pair of flat and parallel facing layers having a fluted layer adhesively secured therebetween.

The blank 11 comprises a base or center wall part 13 which roughly approximates a square, and includes a first pair of generally parallel free side edges 14, and a second pair of generally parallel side edges 15, the latter side edges 15 extending generally perpendicularly relative to the side edges 14 and being defined generally by fold lines. The base wall part 13 includes four corner regions each designated generally at 16, with each corner region being defined by a free corner edge 17 which extends diagonally between the respectively adjacent side edges 14 and 15 This diagonally extending corner edge 17 basically defines a 45° angle in that edge 17 defines an included angle of about 135° at its point of intersection with the side edges 14 and 15. This corner edge 17 results from the fact that a triangular corner part of the base wall part 13 is cut away so that the adjacent side edges 14 and 15 do not directly intersect. This hence provides the base part 13 with a generally eight-sided (i.e., an octagonal) configuration.

The blank 11 also has sidewall parts 18 joined to opposite side edges of the base part 13 through the parallel fold lines 15. Each edge wall part 18 has a length which approximately equals, but is somewhat shorter than, the length of the respectively adjacent side edge 15, and each sidewall part 18 has a width, as measured between the fold line 15 and the free edge 19, which is a small fraction of the length of the respective side wall part 18. The free edge 19 of each sidewall part 18 extends generally parallel with the fold line 15, the latter defining the inner or lower edge of the sidewall part.

Blank 11 further includes a pair of additional wall parts 21 which effectively function as flaps and which project or extend outwardly in cantilevered relationship from opposite ends of each sidewall part 18. Each flap 21 is joined to an adjacent end of the respective sidewall part 18 through a fold line 22 which extends perpendicular throughout the width of the sidewall part and which substantially perpendicularly intersects the edge fold 15 at one end thereof. The intersection of the fold line 22 with the sidewall fold line 15, which intersection point is designated 23 in FIG. 1, is, in the illustrated embodiment, located along the side edge 15 close to but spaced slightly away from the point of intersection with the corner edge 17, with the distance between these two points being defined by a cut line 24 so that the flap part 21 is hence integrally joined solely through the fold line 22 to the respective sidewall part 18.

The flap part 21 is defined by an outer or top free edge 25 which in effect constitutes an extension of the sidewall free edge 19, and in addition at its free end terminates in a free edge 26 which extends generally parallel to the fold line 22. This free edge 26 also extends generally parallel with the respectively adjacent side edge 14, but is spaced slightly inwardly therefrom so that the transverse dimension between the upper and lower free edges 26 as associated with one sidewall part, as shown in FIG. 1, is slightly less than the transverse dimension L between the parallel free edges 14. The flap part 21 also has a further side or lower free edge 27 which extends generally parallel with the free edge 25 and projects outwardly approximately as an extension of the fold line 15.

Each flap part 21 also includes a securing tab or foot 31 which is provided adjacent the free end of the flap part and projects inwardly beyond the side edge 27 toward a center reference plane 32 which perpendicularly intersects the base wall in parallel relationship to the side edges 15. This locking tab or foot 31 projects into and partially occupies the open triangular region which is defined outwardly of the corner edge 17 due to removal of the right-angle corner from the base wall part 13.

The foot or tab 31 is defined by a bottom free edge 33 which is generally parallel with but spaced inwardly from the fold line 15 by a preselected but small distance, which distance will generally be in the range of ¼ to ½ inch. This bottom edge 33 terminates at a rear edge 34 which projects outwardly from the bottom free edge 27 at a location spaced outwardly a significant distance from the intersection point 23. The foot 33 also defines thereon a nose or toe part 35 which projects outwardly a small distance beyond the free end edge 26. This toe part 35 has an upper free edge 36 which functions as a stop or abutment surface, and which is approximately aligned with the side edge 15. The toe part 35 preferably has the outer edge thereof joined to the bottom edge 33 through a rounded corner, and the outermost extremity of the toe part 35 does not extend beyond a imaginary extension of the side edge 14 so as to permit the entire blank 11 to be cut from a length of material no greater than the length L as measured perpendicularly between the free side edges 14.

As illustrated by FIG. 1, the blank 11 is preferably dimensioned so that the length L is slightly greater than the width W of the base wall part as measured perpendicularly between the side fold edges 15. This results in the side edges 15 being slightly longer than the free side edges 14. When a circular pizza is positioned on the base wall part 13, such as illustrated by the dash-dot line 37, this hence results in the pizza being more sidewardly closely confined between the sidewall parts 18, but provides additional clearance between the pizza and the free side edges 14 so as to hence define edge portions along the free edges 14 of the base wall part 13 which effectively function as handles so as to facilitate gripping of the tray. In an embodiment of the invention, the length L will typically be at least about 1 inch greater than the width W.

Each corner region 16 of the base wall part 13 is also provided with a slit or slot arrangement 41 for cooperation with the adjacent foot 31 when the blank is assembled to define the tray. This slit arrangement 41 includes an elongate slit or cut 42 which extends through the thickness of the blank, and is spaced inwardly from and in the illustrated embodiment extends generally parallel to the adjacent corner edge 17. This slit 42, however, is a blind slit in that it terminates entirely within the main wall part, and does not intersect the edges thereof. The length of slit 42 is sized so as to permit vertical passage of the foot 31 therethrough, and for this purpose the slit arrangement also includes a slit extension 43 for permitting passage therethrough of the nose or toe part 35.

The slit arrangement 41 also includes a pressure flange or tab 44 which is an integral part of the base wall part 13 and is normally maintained coplanar therewith when the blank is in a flat condition. This pressure flange 44 has one edge thereof defined by the cut or slit 42, and has an opposite edge thereof defined by a short fold line 46 which extends generally parallel with the cut 42. The side edges of the pressure tab 44 are defined by side cut or score lines 47 which extend between the respectively adjacent ends of the fold line 46 and score line 42, whereby score lines 47 effectively constitute extensions of the score line 42. The score extension 43 extends outwardly away from one of these latter side cut lines 47. The pressure flange 44 is adapted to deflect downwardly away from the base wall part 13 by folding downwardly about the fold line 46 when the respective foot 31 is inserted vertically downwardly through the slit arrangement 41, as described below.

Figure 2:
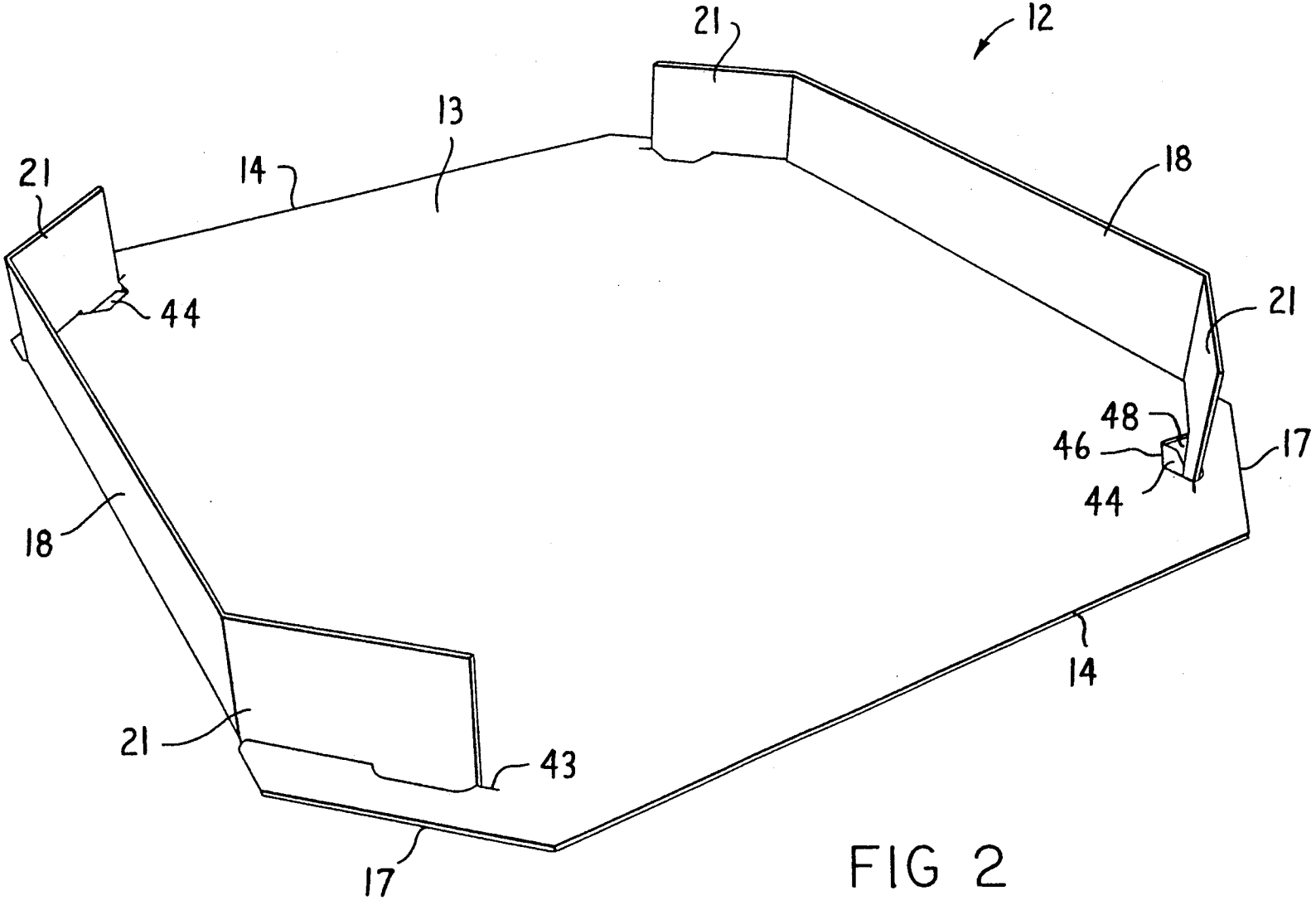
FIG. 2 shows an overhead perspective view of the assembled blank in the form of a pizza tray.
Figure 3:
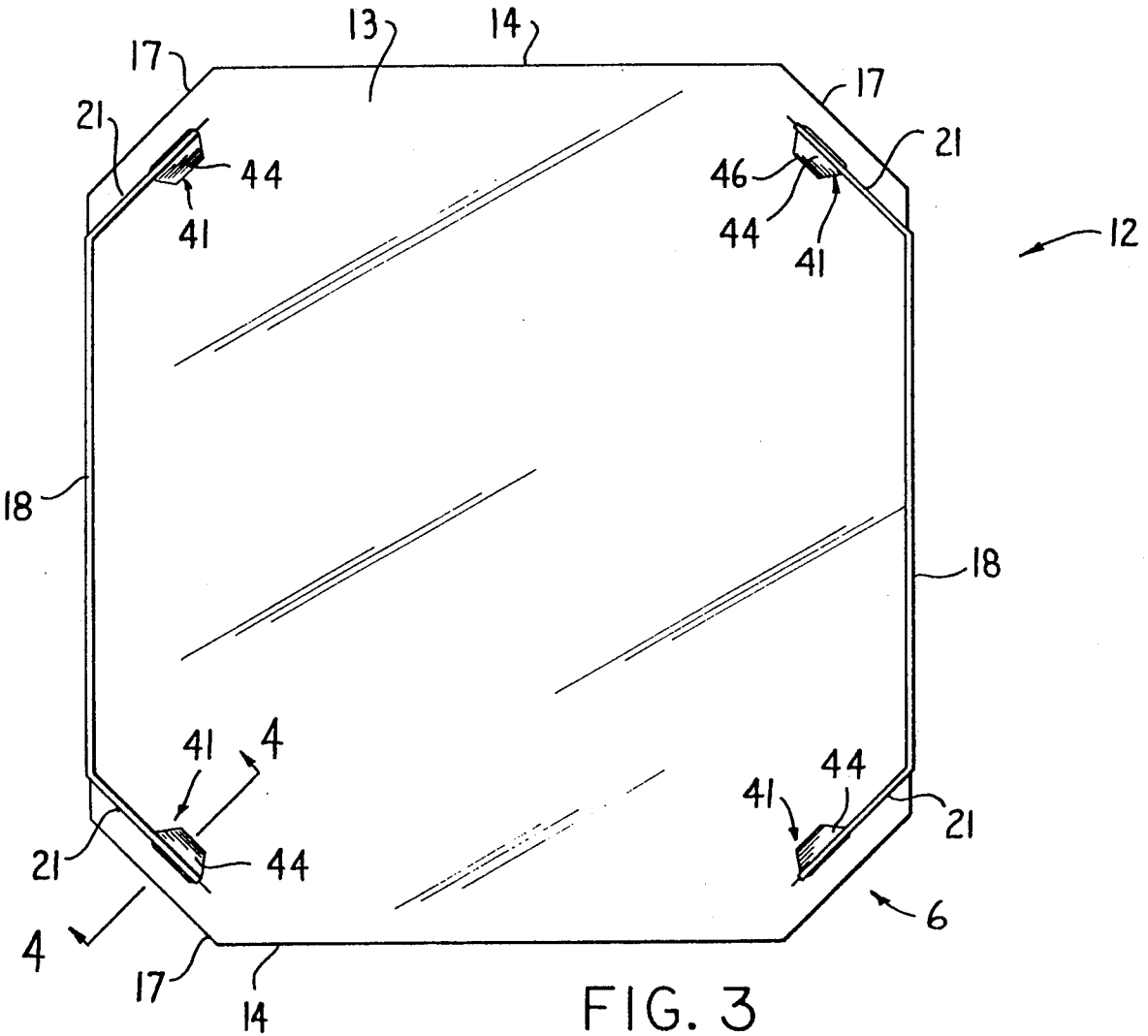
FIG. 3 is a plan view of the assembled pizza tray.

The blanks 11 will normally be maintained in the flat condition illustrated by FIG. 1, which facilitates compact shipping thereof, and also facilitates compact storage thereof until use is desired. When use is desired, such as for supporting a pizza thereon, then the blank 11 is assembled in the manner described below so as to form the tray 12 as illustrated by FIGS. 2 and 3.

Figure 5:
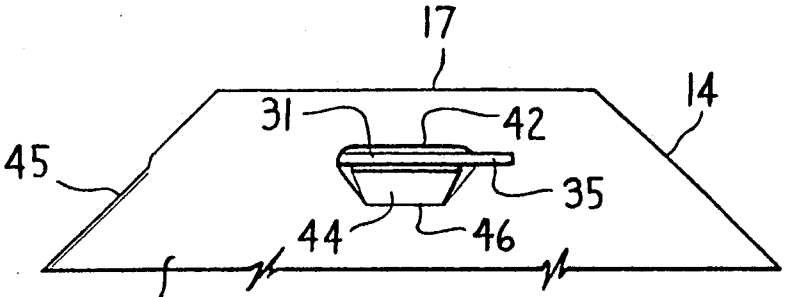
FIG. 5 is an enlarged fragmentary bottom view of a corner portion of the tray showing a pressure tab extending down through a slot.
Figure 6:
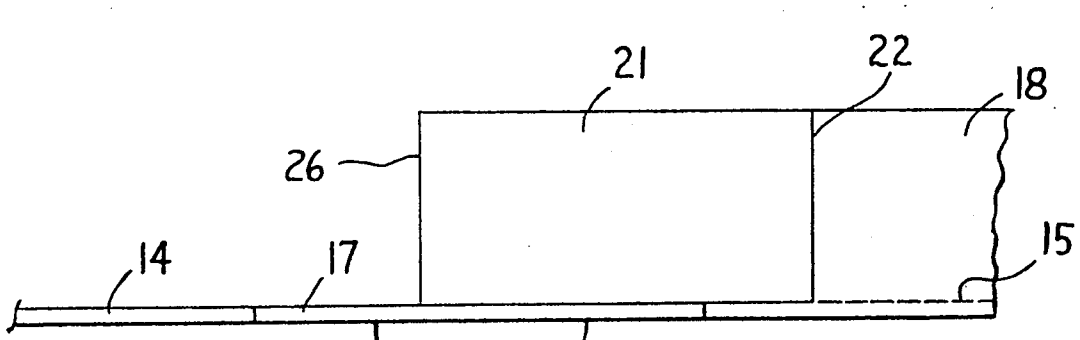
FIG. 6 is an enlarged fragmentary side view taken in the direction of arrow 6 in FIG. 3.
Figure 4:
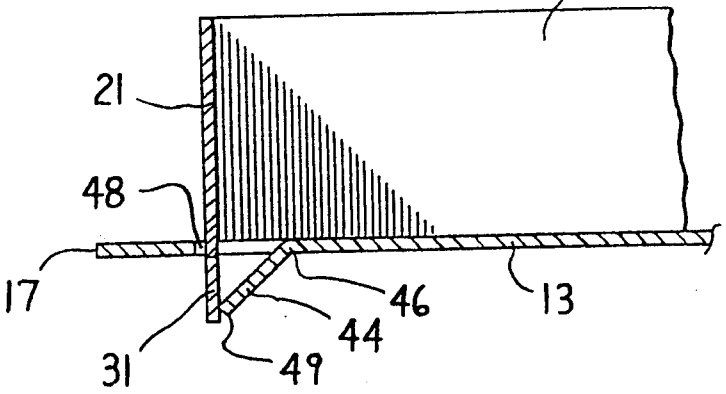
FIG. 4 is an enlarged fragmentary sectional view along line 4—4 in FIG. 3.

To assemble the tray, the sidewalls 18 are initially manually folded upwardly about the fold lines 15, and at about the same time the flaps 21 are folded inwardly about the fold lines 22 through an angle of about 45° relative to the plane of the respective sidewall. With the sidewalls 18 folded upwardly through angles which approach but are somewhat less than 90°, and the end flaps 21 folded inwardly, this results in the end flaps 21 projecting inwardly above the corner regions 16 of the main wall part 13, with the feet 31 being disposed closely adjacent and generally directly above the respective slit arrangements 41. Each sidewall 18 is then folded upwardly an additional amount so as to be disposed in generally perpendicular or upright position relative to the base wall 13, and at the same time the two related end flaps 21 are pushed downwardly to cause the feet 31 to be pressed downwardly through the slit arrangements 41 until the feet 31 are effectively secured beneath the main wall 13 in the manner illustrated by the FIGS. 4–6.

During the insertion of each foot 31 downwardly through the respective slit arrangement 41, the bottom edge of the foot 31 contacts the upper surface of the pressure flange 44. The downward pushing of the foot causes the pressure flange 44 to deflect downwardly about the fold line 46, thereby resulting in formation of a slot or opening 48 which permits downward passage of the foot 31 therethrough. The foot 31 is pushed downwardly through this opening or slot 48 substantially until the lower edge 27 of the flap 21 abuts the upper surface of the base wall part 13. As the pressure tab 44 folds downwardly due to the downward pressure and movement exerted by the foot 31, the free edge 49 of the flange 44 sidewardly retracts due to the downward folding so as to move into contact with the side face of the foot, following which the natural memory of the corrugated (that is, the tendency of the corrugated to return to its original position) causes the pressure flange 44 to function like a leaf spring in that the free edge 49 thereof is pressed against the side face of the foot 31 to hence assist in holding the foot securely in position, and resists any tendency for the foot to be moved upwardly.

In addition to the above, when the foot 31 is moved downwardly through the slit arrangement, the toe or nose part 35 additionally is forced downwardly through the slit extension 43 (which extension will typically be in the range of ¼ to ½ inch in length) so that this nose part passes entirely through the slit 43 until the upper surface 36 thereof is generally below the base wall part 13. The natural resiliency or memory of the corrugated causes the slit 43 to at least partially reclose after passage of the nose part 35 therethrough, whereupon this nose part is hence effectively locked beneath the main wall part 13 to make withdrawal of the foot from the slit very difficult. In fact, withdrawal of the foot from the slit can normally be accomplished only by imposition of excessive pulling force which will damage the tray.

When all four feet 31 are locked in the respective slit arrangements 41 so as to be positioned as illustrated in FIG. 3, the sidewalls 18 and the respective flaps 21 are effective locked in a vertical position to hence provide a stable sidewall structure which facilitates the positioning of the pizza on the tray, the confinement of the tray and pizza within a bag, and the transporting and overall handling of the packaged pizza.

Further, with the tray in the assembled condition as illustrated by FIG. 3, and with the pizza supported on the base wall 13 for confinement generally within and between the sidewalls 18 and the corner flaps 21, the extra length L defined between the free edges 14 results in handle portions which greatly facilitate handling of the pizza tray without touching the pizza supported thereon.

The inward angled relationship of the corner flaps 21, which flaps define an included angle of about 135° with respect to the adjacent sidewalls 18, also provides for partial confinement of the pizza in the lengthwise direction since, even though the sides of the tray as defined between the opposed free edges of the flaps 21 are open, nevertheless this sideward opening is generally less than the diameter of the pizza and hence provides for better confinement of the pizza.

The blank 11 used for forming the tray 12 also permits minimal usage of corrugated cardboard material. This is achieved with the above-described configuration because of the cutting out of the 90° corners, thereby defining the angular corner edges 18 and hence leaving part of the unused corner material available for use in defining the feet 31, each of which is defined by part of the unused corner material and hence projects into the open corner region.

The blank 11 is prepared using techniques which are conventional and well-known in the box forming industry. While the blank for the tray is preferably constructed of corrugated cardboard, the blank can be constructed of other materials if desired, including cardboard and the like.

It will be recognized that the blank 11 could be configured so that the main wall part 13 is provided with square (i.e., right angle) corners if desired, in which case the corner flaps 21 when in the flat blank form would project outwardly a limited extend beyond the adjacent side edge of the main wall part.

With the tray of this invention assembled as described above, the feet 31 project downwardly from the base wall 13 and hence enable the tray, when bearing a hot pizza thereon, to be positioned on a table top or other supporting surface while at the same time the feet 31 maintain the base wall 13 of the tray spaced upwardly out of contact with the supporting surface. This hence permits the tray to be more conveniently utilized as a serving tray without fear of damaging the underlying supporting surface.

This tray 11 also provides for better protection of the pizza when the tray and pizza are disposed in a paper bag since the rigidity of the sidewalls 18 and corner flaps 21 hence provide much more secure support of the top wall of the bag so as to prevent or minimize its contacting the top of the pizza. This rigidity provided by the sidewalls of the tray also facilitate stacking of several such trays and pizzas when contained in bags, either for temporary storage or for handling, since even though two such packages may be stacked one on top of the other, the side wall structure will not collapse, and hence can sustain the weight of an upper package while still maintaining the top wall of the bag effectively spaced from the pizza.

Further, particularly with this latter described embodiment, the corner flaps could be folded inwardly through angles of about 90° so as to project perpendicularly inwardly from the sidewalls when lockingly engaged with the base wall if desired. With these latter variations, however, each blank would require usage of a greater amount of corrugated board material, and result in greater wastage of such material, in comparison to the same sized tray embodying the features illustrated by FIGS. 1-3.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A pizza tray blank comprising a flat one-piece blank of thin sheetlike cardboard, said blank including:

an enlarged generally planar base wall having four corner regions;

a pair of elongate and generally parallel sidewalls positioned adjacent opposite sides of said base wall;

a pair of flaps extending outwardly from opposite ends of each said sidewall;

each of said flaps having a foot extending inward toward a central plane that perpendicularly intersects a center of said base wall and extends parallel to the elongated direction of the opposing sidewalls;

each foot having a toe extending therefrom in a direction parallel to said central plane;

a pressure tab in each of said corner regions corresponding to each said foot, each of said pressure tabs defined by pressure tab score lines and a pressure tab fold line, each said pressure tab being adapted for locking engagement with a respective said foot;

a score line extension extending outward from each of said pressure tabs and corresponding to each of said respective toes for locking engagement of said toe;

sidewall fold lines defined between each said sidewall and a respective edge of the base wall, said sidewall fold lines running in a direction parallel to said central plane; and an extension fold line defined between each flap and its respective sidewall and running in a direction perpendicular to said central plane.

2. The blank of claim 1, wherein the blank is made of corrugated cardboard.

3. A pizza tray comprising:

a generally horizontal enlarged and planar base wall having four corner regions, said base wall having a pair of generally parallel first side edges;

a pair of opposing and generally parallel upright sidewalls folded upward from said base wall about generally horizontal first fold lines which extend along said first side edges;

a pair of upright extension walls joined to opposite ends of each said sidewall about second fold lines which extend substantially perpendicularly to said first fold lines and which define end edges of said sidewalls, said extension walls being cantilevered away from the respective second fold lines, and said extension walls being folded inwardly about the second fold lines so as to overlie and project upwardly from a respective corner region;

each of said extension walls having a foot extending downward therefrom and vertically through a corresponding slit arrangement in the respective corner region to secure the extension wall to the base wall with the extension wall being angled inwardly from the respective sidewall, said slit arrangement extending vertically through the base wall at a location spaced inwardly from the edge thereof; and said tray being formed from a one-piece flat blank of thin sheetlike material folded about said fold lines.

4. The pizza tray of claim 3, wherein each slit arrangement includes a pressure tab foldable downwardly from the base wall to define a slot through which the foot vertically extends, said pressure tab resiliently bearing against a side face of the foot to securely and stably hold the foot within the slot.

5. The pizza tray of claim 4, wherein the feet all project downwardly below the bottom wall through a limited vertical extent to permit the tray to be supported on a supporting surface while maintaining the base wall spaced upwardly out of engagement with the supporting surface.

6. The pizza tray of claim 3, wherein the entire tray is made from a one-piece blank of corrugated cardboard.

7. The pizza tray of claim 3, wherein the assembled tray is generally in the shape of an octagon.

8. The pizza tray of claim 3, wherein each extension wall is folded inwardly at about a 45° angle relative to the sidewall from which it extends.

9. The pizza tray of claim 3, wherein the feet all project downwardly below the bottom wall through a limited vertical extent to permit the tray to be supported on a supporting surface while maintaining the base wall spaced upwardly out of engagement with the supporting surface.

10. A pizza tray comprising:

a one piece blank comprising a generally horizontal planar base wall having four corner regions;

a pair of opposing vertical sidewalls folded upward from opposite sides of said planar basewall about horizontal sidewall fold lines;

a pair of vertical extension flaps folded inwardly about vertical fold lines defined at opposite ends of each said sidewall so that said flaps overlie said base wall;

each said flap having a foot extending downward therefrom and through a corresponding slot in a respective said corner region, said slot defined by score lines and a pressure tab fold line; and a pressure tab joined to said base wall by each said pressure tab fold line and angling downwardly from said pressure tab fold line and being pressingly engaged against the respective foot to hold said foot in its respective slot and prevent said vertical sidewalls and flaps from collapsing.

11. The pizza tray of claim 10, wherein each of said slots has a score line extension extending outwardly therefrom and each of said feet has a toe extending outwardly therefrom, said toe corresponding directly to a respective said score line extension and being lockingly engaged by said respective score line extension.

* * * * *